United States Patent [19]

Johnson

[11] 3,939,740

[45] Feb. 24, 1976

[54] WRAPPER CUTTER FOR AUTOMATIC CIGAR WRAPPING MACHINE

[75] Inventor: Herman W. Johnson, Richmond, Va.

[73] Assignee: AMF Incorporated, White Plains, N.Y.

[22] Filed: May 7, 1974

[21] Appl. No.: 467,690

[52] U.S. Cl. ..... 83/24; 131/26; 131/105; 83/98; 83/100; 83/511

[51] Int. Cl.[2] ..... A24C 1/04

[58] Field of Search ..... 131/26, 58, 30, 83 R, 105; 83/510–512, 98, 99

[56] References Cited

UNITED STATES PATENTS

| | | | |
|---|---|---|---|
| 654,178 | 7/1900 | Patterson et al. | 131/26 |
| 719,279 | 1/1903 | Tyberg | 131/26 |
| 811,108 | 1/1906 | Tyberg | 131/105 |
| 2,215,490 | 9/1940 | Wheeler | 131/105 X |
| 2,451,920 | 10/1948 | Clausen | 131/105 X |
| 2,960,898 | 11/1960 | Wheeler | 131/105 X |
| 3,016,779 | 1/1962 | Gustavson et al. | 83/510 X |
| 3,139,091 | 6/1964 | Godfrey et al. | 131/30 |
| 3,171,311 | 3/1965 | Carlson | 83/98 |
| 3,318,178 | 5/1967 | Richard | 83/98 |

*Primary Examiner*—Joseph S. Reich
*Attorney, Agent, or Firm*—George W. Price; Charles J Worth

[57] ABSTRACT

Method and apparatus for the removal of tobacco cuttings in the wrapper cutting portion of a cigar making machine in which a hollow, rotatable die turret having a pair of hollow die units on its upper surface, air openings at its lower surface and passageways from such openings to the interior of the units, is rotatably mounted on a stationary support having a pair of air chambers therein with openings in the upper wall thereof which permit air to flow into or out of the turret passageways through the openings at its lower surface at various portions of the cycle of rotation of the turret. Each die unit has holes around the periphery of the cutting edge which extend into the die unit interior. One of the chambers is kept continuously under vacuum sc that during part of the rotation of the turret, air is drawn through the die unit holes to maintain a strip of tobacco on top of a die unit. The other chamber successively is a vacuum chamber, contains air under pressure or contains air at atmospheric pressure, a cycle which repeats. After the strip is cut and the cut strip is removed, the turret rotates and the other chamber which then contains air under pressure is connected through the turret to the interior of the die unit from which the cut strip was removed thereby causing air to flow out of the die unit holes and causing any tobacco cuttings to be dislodged. As the cuttings are dislodged, they are removed by a nozzle connected to vacuum means.

9 Claims, 7 Drawing Figures

WRAPPER CUTTER FOR AUTOMATIC CIGAR WRAPPING MACHINE

This invention relates to the manufacture of cigars and cigar-like products and particularly, to methods and apparatus for the cutting of cigar wrappers and the removal of surplus wrapper cuttings.

Automatic cigar wrapping machines are well-known in the art and usually comprise means for die cutting the wrapper, means for feeding the wrapper material to the die cutting means and means for transferring the cut wrapper to paste applying means and then to apparatus for wrapping the cut wrapper around a cigar bunch. Examples of such machines and mechanisms thereof are set forth in U.S. Pat. Nos. 811,108; 2,451,920; 2,960,898 and 3,139,091, and in the patents referred to therein. Another well-known type of cigar wrapping machine which is in use in the field is the Model 2-90 machine manufactured by AMF Incorporated, White Plains, N.Y., and the invention is particularly useful in connection with such machine.

The wrapper material may be specially selected natural tobacco leaf or may be a reconstituted tobacco sheet which is a thin, paper-like material formed from finely divided tobacco, binders, flavorings, etc. Such sheet may be uncoated or may be coated to improve its moisture retarding and resisting properties. As used hereinafter, the expression "a strip of tobacco" includes a strip of natural leaf or a strip of such sheet.

In machines of the type identified hereinbefore, the wrapper material is held against the cutting die during the cutting step by vacuum means, and after the cut wrapper has been removed from the cutting die, the cutting die is moved to a new position. As the cutting die is moved, it passes a vacuum nozzle which removes wrapper cuttings adjacent the die cutting edges. However, it has been found that the cuttings are not always removed satisfactorily, particularly when reconstituted tobacco sheet is used as the wrapper material. This appears to be due to the smoothness of the reconstituted sheet and its tendency to become sticky by absorption of moisture which causes the cuttings to stick to the die shell around the cutting edges. Accumulation of the cuttings interferes with the vacuum holding means and also decreases the height of the cutting edges above the surrounding surfaces, thereby interfering with proper cutting of the wrapper material. When the cuttings accumulate, it is necessary to stop the machine for manual removal of the cuttings, which is undesirable.

From experiments which I have conducted, I have discovered that the problems encountered with the tendency of the wrapper cuttings to stick to the die shell may be substantially eliminated by subjecting such cuttings to air under pressure on the surface thereof which normally engages the surface of the shell, such air under pressure lifting the cuttings from the shell surface so that they may be readily removed by vacuum means. In accordance with the preferred embodiment of the invention, such air under pressure is directed on the cuttings through the holes in the die shell normally connected to vacuum means for holding the wrapper material against the cutting edge of the die, and the production of a vacuum and the supply of air under pressure is controlled by control means in a way such that the production of a vacuum is maintained until the wrapper material has been cut and the cut wrapper is transferred and, thereafter, air under pressure is supplied to the holes to dislodge the cuttings from the surface of the die shell.

In the preferred embodiment of the invention, a pair of similar die units, each comprising a re-entrant cutting edge of the desired cut wrapper shape surrounded by a hollow shell having a perforated upper portion adjacent and outside the cutting edge, the outer size of said shell portion corresponding to the outer size of the strip of tobacco to be cut, are mounted on a rotatable die turret of known type at positions 180° from each other. The strip of tobacco to be cut is fed in a conventional manner to one of the dies on which it is held, at least in part, by suction applied through said perforations. The turret is then indexed through 180° where the strip is pressed against the die cutting edge in a conventional manner, such as by pressure rollers, and is cut to the desired shape leaving surplus strip on said perforated upper portion of the die shell. The cut strip is then transferred in a known manner to further conventional processing apparatus, such as pasting and wrapper applying apparatus. After the cut strip is so transferred, the turret is again indexed through 180° and the die from which the cut strip was removed passes beneath a vacuum nozzle. Immediately before, or as, the turret is indexed, suction is removed from said perforations, and before and/or during the passage of the die beneath said vacuum nozzle, air under pressure is supplied to said perforations and directed thereby on the surfaces of the strip cuttings which engage said portion of the die shell causing the cuttings to be released and to be withdrawn by the vacuum nozzle. After said portion of the die shell passes from beneath the nozzle and at least by the time the die unit is in its original position and receives a new strip, suction is again applied to the perforations to hold the new strip on the die.

One object of the invention is to provide a method and apparatus for reliably removing tobacco cuttings from cutting die apparatus used in conjunction with cigar making machines.

Another object of the invention is apparatus for accomplishing the object set forth hereinbefore which can easily be installed with relatively few modifications on commercially used cutting die apparatus.

The present invention will be better understood from the following detailed description of the preferred embodiment of the invention, which description should be considered in conjunction with the accompanying drawings, in which.

Figure 7:
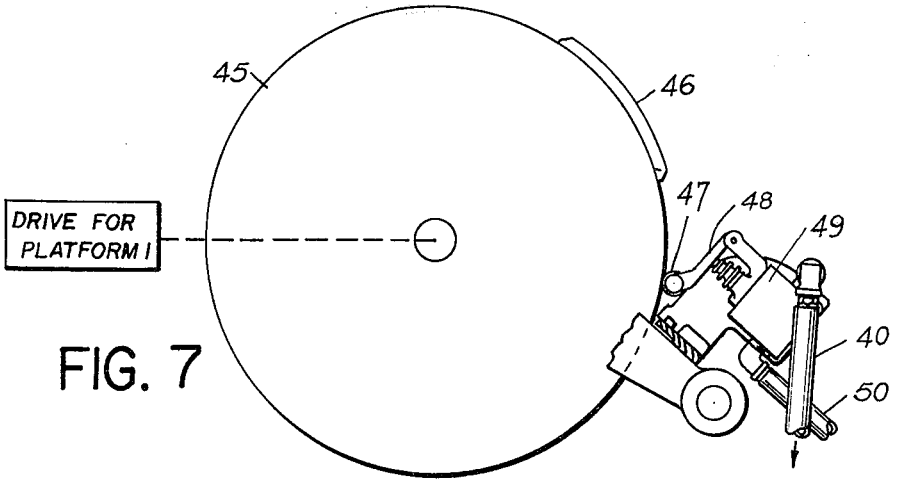
Figure 3:
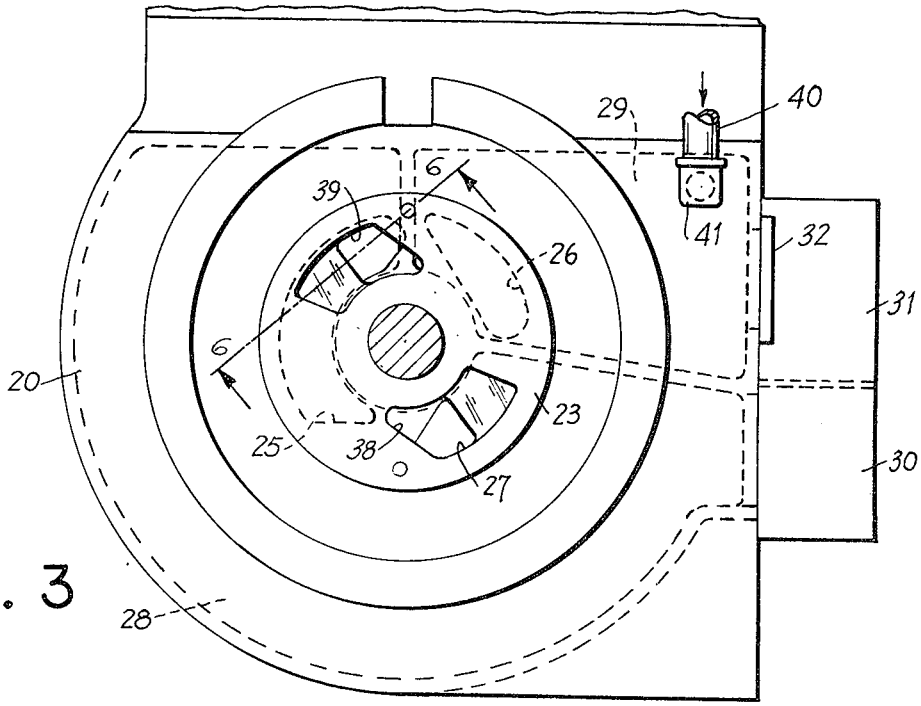
FIG. 3 is a plan view of the lower portion of the apparatus shown in FIG. 2 with the parts above the valving element removed.
Figure 4:
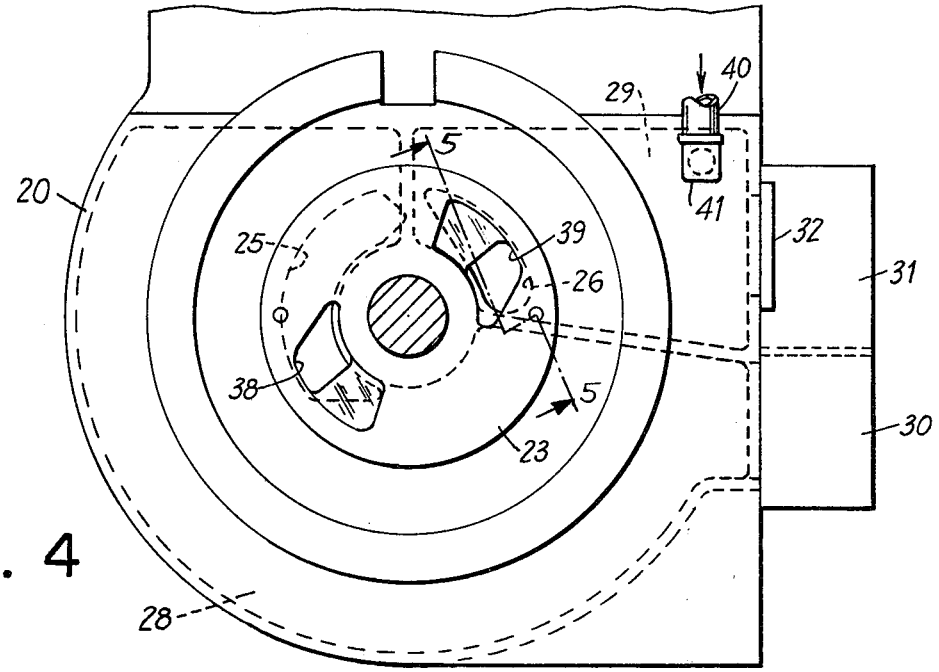
FIG. 4 is a plan view similar to FIG. 3 but showing certain parts in different relative positions.
Figure 5:
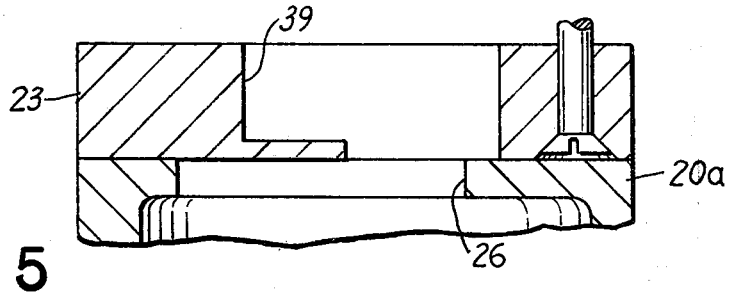
Figure 6:
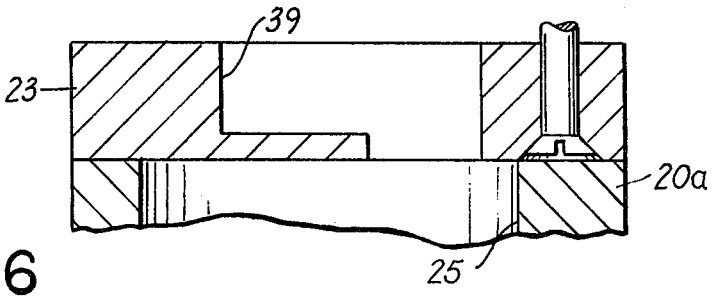

FIGS. 5 and 6 are enlarged, fragmentary, cross-sectional views of elements forming part of the embodiment shown in the preceding figures and are taken respectively along the section line 5—5 shown in FIG. 4 and the section line 6—6 shown in FIG. 3; and FIG. 7 is a diagrammatic, plan view of apparatus employed with the embodiment shown in the preceding figures for the control of the supply of air under pressure to a die.

Figure 1:
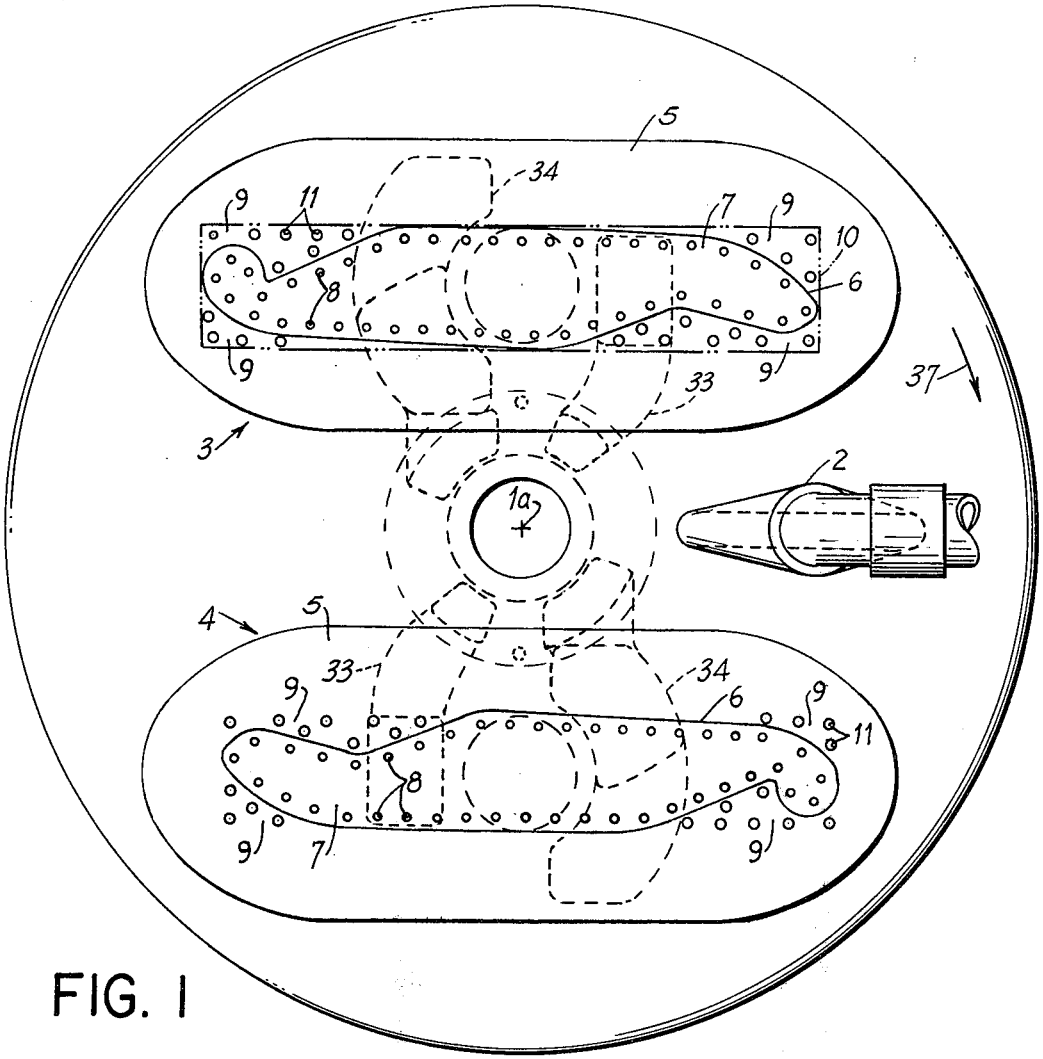
FIG. 1 is a plan view of the die turret portion of wrapper cutting die apparatus incorporating the invention.

FIG. 1 represents a plan or top view of the die turret portion of cigar wrapper cutting apparatus similar to the die turret portion of wrapper cutting apparatus well-known in the art. The die turret illustrated may, for example, correspond to the die turret illustrated and described in U.S. Pat. No. 2,960,898 or may be the die turret portion of the Model 2–90 cigar making machine manufactured by AMF Incorporated and identified hereinbefore.

The apparatus illustrated in FIG. 1 comprises a rotatable platform 1, a vacuum nozzle 2 and a pair of identical die units 3 and 4. In a manner known to those skilled in the art, such as, for example, the mechanisms in said U.S. Pat. No. 2,960,898, the platform 1 may be indexed around its axis 1a from the position shown through 180° so that the positions of the die units 3 and 4 are interchanged. Thereafter, the platform 1 may be again indexed through 180° until the die units 3 and 4 are in the positions shown in FIG. 1.

Each of the die units 3 and 4 comprises a hollow shell 5 and a cutting edge 6 having a shape to which it is desired to cut a strip of tobacco and defining a space of said shape therewithin. A hollow core 7 is mounted in said space and is vertically movable in a manner known to those skilled in the art for the purpose of transferring a cut wrapper from the die unit to a transfer head (not shown), which transfers the cut wrappper to subsequent processing apparatus, such as pasting and wrapping apparatus. Each core 7 has a plurality of holes 8 therethrough for applying suction to the lower surface of a strip of tobacco on the die unit. It will be observed that each cutting edge 6 is re-entrant, and, although the shape of the cutting edge 6 illustrated represents one form employed in the art for producing a wrapper cut in a shape to be wrapped around a cigar bunch, it will be understood that other shapes may be employed.

The shell 5 of each die unit has an upper surface portion 9 (FIGS. 1 and 2) with an outer size corresponding to the outer size of the strip of tobacco to be cut, one such strip being indicated by the phantom lines 10. Such upper surface portion 9 has a plurality of holes 11 which extend from the upper surface of the portion 9 to the interior of the shell 5 for purposes hereinafter described. It will be noted that the portion 9 is outside of the cutting edge 6 and is adjacent and extends along portions of the cutting edge 6. Preferably, the size and number of holes 11 is such as to occupy between 20–30 percent of the area of the portion 9 outside the cutting edge 6.

The vacuum nozzle 2 forms part of the controlled vacuum means for removing the surplus portions of the strip of tobacco after it has been cut by the cutting edge 6. The vacuum nozzle 2 is connected to a valve controlled vacuum device (not shown) which is of a type well-known in the art.

Figure 2:
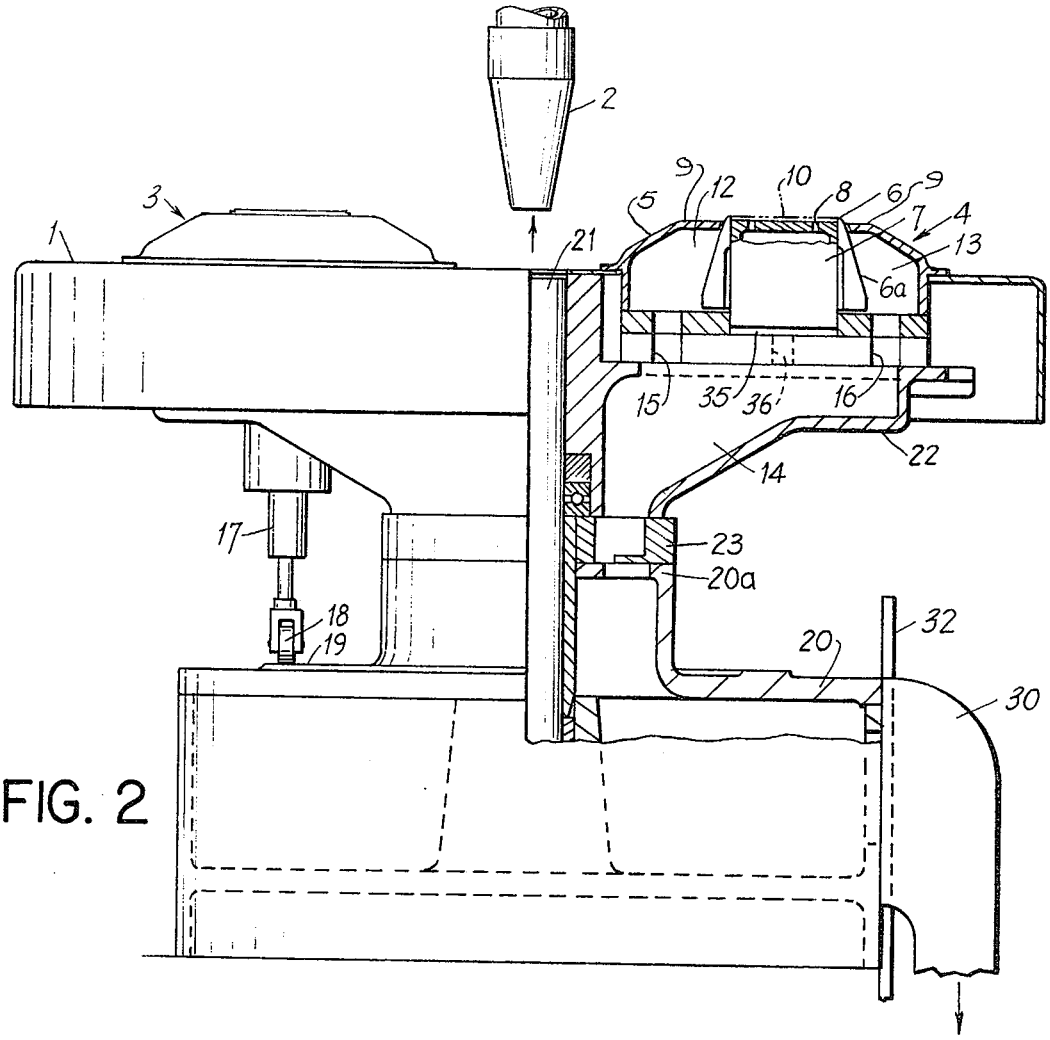
FIG. 2 is a side elevation view, partly in section, of the apparatus shown in FIG. 1.

With reference to FIG. 2, it will be observed that the shell 5 is hollow and abuts the die body **6*a* having the cutting edge 6, thereby providing an air chamber around the die body 6*a*, two portions of which being identified by the reference numerals 12 and 13. Each of said portions 12 and 13 is in air communication with a further air chamber 14 through a pair of openings 15 and 16**.

Each core 7 is mounted on a shaft 17 which extends through the chamber 14 and carries a roller 18 at the lower end thereof which rides on a rail 19. The core 7, the shaft 17, the roller 18 and the rail 19 correspond respectively to the die block 280, the rod 282, the roller 283 and the track 284 shown in FIG. 15 and described in columns 9 and 10 of said U.S. Pat. No. 3,139,091 and, as described in U.S. Pat. No. 3,139,091, the shaft 17, and hence the core 7 carried thereby, is raised above the cutting edge 6 after the wrapper has been cut to transfer the cut wrapper to a transfer head. During such raising of the shaft 17 and the core 7, the cut wrapper is retained on the core 7 by means of suction applied to the cut wrapper through the holes 8 in the core 7. When the cut wrapper has been raised to the position in which the cut wrapper can be removed by the transfer head, suction on the cut wrapper through the holes 8 is discontinued and the core 7 is then lowered to the position shown in FIG. 2.

Referring again to FIG. 1, the strip of tobacco to be cut is supplied to the die unit which is in the position of the die unit 4 in any well-known manner, such as by means of the apparatus shown in said U.S. Pat. No. 2,960,898. Thereafter, the platform 1 is rotated through 180° as described hereinbefore until it is in the position of the die unit 3 illustrated in FIG. 1. Of course, at the same time, the die unit 3 is moved to the position of the die unit 4 shown in FIG. 1.

When the strip of tobacco is first supplied to a die unit, suction is applied to the lower surface of the strip through the holes 11 and, if desired, through the holes 8, to retain the strip on the cutting edge 6. Said suction is maintained on the strip during the rotation of the platform 1 and during the time that the strip is cut to the desired shape.

When the die unit, either die unit 3 or die unit 4, carrying a strip of tobacco reaches the position of die unit 3 shown in FIG. 1, the strip of tobacco is pressed against the cutting edge 6, such as by the rollers 25 shown in FIG. 3 in U.S. Pat. No. 3,171,311, or the rollers 224 which are shown in FIG. 2 and described in said U.S. Pat. No. 2,960,898, thereby causing the cutting of the central portion of the strip of tobacco into the shape of the cutting edge 6 and leaving surplus portions, known as cuttings, on the portion 9 of the shell 5. After the cut strip has been transferred and usually after rotation of the platform 1 commences, suction through the holes 11 is discontinued.

Let it be assumed that the strip of tobacco on the die unit 3 has been cut and that the cut wrapper has been transferred as described. Thereafter, indexing of the platform 1 through 180° is commenced, and it will be noted that the die unit 3 will pass beneath the vacuum nozzle 2. As indexing of the platform 1 is commenced, or shortly thereafter, the vacuum means of which the nozzle 2 forms a part, is activated so that as the die unit 3 passes beneath the nozzle 2, cuttings on the portion 9 of the shell 5 are drawn into the nozzle 2. However, as mentioned hereinbefore, the cuttings sometimes stick to the portion 9 and resist removal by means of the nozzle 2.

In accordance with the invention, removal of the cuttings from the portion 9 is assured by supplying air under pressure, such as air at 25 p.s.i., or less, to said air chamber around the die body **6*a* (FIG. 2), and hence, to the interior of the shell 5, so as to apply air under pressure to the surface of the cuttings which engage the surface portion 9. Such air dislodges the cuttings from the surface portion 9 so that the cuttings are readily removed through the nozzle 2** as the die unit passes therebeneath. Air under pressure is supplied to said air chamber shortly after the indexing of the platform 1 commences and, preferably, is continued at least until the trailing edge of the portion 9 passes from under the nozzle 2.

The die turret comprises a stationary bracket 20 which rotatably receives a turret driving shaft 21 secured to a support 22 which is rotatable with the shaft 21 along with a baffle or valving element 23.

As illustrated in FIGS. 3–6, the stationary bracket 20 has openings 25, 26 and 27 in the upper portion 20*a* thereof which extend from the interior of the bracket 20 to the lower surface of the baffle 23. As indicated in FIGS. 3 and 4, the interior of the bracket 20 is divided into a pair of chambers, a vacuum chamber 28 defined by the lower wall 28*a*, the upper wall 28*b* (FIG. 2) and the side walls 28*c*, 28*d*, 28*e* and 28*f* (FIG. 3) and a control chamber 29 defined by the lower wall 28*a*, the upper wall 28*b* (FIG. 2) and the side walls 28*c*, 28*d*, 28*e* and 29*f* (FIG. 3). Air is continuously withdrawn from the chamber 28 through a duct 30 which is connected to any known type of vacuum device, the rate of withdrawal of air from the chamber 28 being sufficient to maintain the strip of tobacco on the die units without damaging such strip.

The control chamber 29 is similarly connected through an aperature 29*b* to a duct 31 which, when the shutter 32 between the duct 31 and the chamber 29 is in its open position, withdraws air from the control chamber 29. The duct 31 may be connected to the same vacuum device as the duct 30. The shutter 32 is cam operated in a manner well-known in the art and is in its open position when the die unit which carries a strip of tobacco to be cut reaches the position shown in FIG. 1, to thereby draw air through the holes 8 in the core 7. However, the shutter 32 is in its closed position when the cut wrapper is being transferred from the core 7 to the transfer head, thereby discontinuing the suction on the cut wrapper and permitting it to be transferred to the transfer head. The shutter 32 remains in its closed position until a succeeding die unit is indexed substantially to the position of the die unit 3 shown in FIG. 1.

The air chamber 14 is subdivided by suitable partitions indicated by dotted lines 33 and 34 in FIG. 1 so that, when the platform 1 is in the position shown in FIGS. 1 and 2, the space 35 beneath the core 7 of the die unit 3 has air communication through the opening 26 and a portion of the chamber 14 with the control chamber 29, and air communication between the interior of the core 7 and the vacuum chamber 28 is cut off. At points intermediate the travel of the die unit from the position of the die unit 4 to the position of the die unit 3, the space 35 beneath the core 7 is in communication with the vacuum chamber 28. Thus, for example, in the position of the die unit 4 shown in FIG. 1, the core 7 of the die unit 4 does not have air communication with either the vacuum chamber 28 or the control chamber 29. The core 7, at this point, is separated from other chambers by separate valving (not shown) which is operated by the machine cam means. However, as the platform 1 is rotated in the direction indicated by the arrow 37 shown in FIG. 1, air communication between the space 35 and the vacuum chamber 28 is established through the opening 36, a portion of the air chamber 14 and the opening 25. Such air communication continues until the die unit 4 is substantially at the position of the die unit 3 shown in FIG. 1, at which time air communication is established between the space 35 and the control chamber 29 through the opening 26. When the platform 1 is further rotated the air communication of the space 35 with the control chamber 29 is eventually cut off. Then air communication with the chamber 28 is reestablished and thereafter, cut off when the die unit 4 reaches the position shown in FIG. 1. The core 7 of the die unit 3 is similarly connected with the chambers 28 and 29 as the platform 1 rotates. Such operation of the die turret and the interconnection of the core 7 with the vacuum chamber 28 and the control chamber 29, as well as the operation of the shutter 32, are well-known in the art and the mechanisms, etc. for accomplishing such operation are included in the Model 2-90 cigar wrapping machine identified hereinbefore.

The baffle or valving element 23 has a pair of openings 38 and 39 which control the air communication between the portions of the chamber 14 which connect to the interior of the shell 5 through the openings 15 and 16 and the vacuum chamber 28 and the control chamber 29. For simplicity in illustration, the corresponding openings in the element 23 for the connection of the cores 7 to the chambers 28 and 29 have been omitted in FIGS. 3 and 4. Thus, when the die units are in the positions shown in FIG. 1, the interior of the shell 5 of the die unit 3 is connected to the vacuum chamber 28 through the opening 39, and the interior of the shell 5 of the die unit 4 is connected to the vacuum chamber 28 through the opening 38. As the platform 1 is rotated in the direction of the arrow 37, i.e., toward the position shown in FIG. 4, the leading edge of the opening 39 reaches the opening 26 in the bracket 20 so that there is air communication between the interior of the shell 5 of the die unit 3 and the control chamber 29. At this time, the shutter 32 has closed the aperture 29*b*, but air under pressure is supplied to the control chamber 29 through the air line 40 and the outlet nozzle 41 when the trailing edge of the opening 39 overlaps the wall between the vacuum chamber 28 and the chamber 29. Accordingly, when air under pressure is supplied to the control chamber 29 and at least part of the opening 39 is aligned with the opening 26, air under pressure is supplied to the interior of the shell 5 causing air to flow through the holes 11 in the surface portion 9, such air dislodging any scraps or cuttings which may be on the surface portion 9. At the time that air under pressure is supplied to the chamber 29, the vacuum means of which the nozzle 2 forms a part is activated in a known manner causing the scraps dislodged from the surface portion 9 to be removed through the nozzle 2. The supply of air under pressure to the control chamber 29 and the withdrawl of cuttings through the nozzle 2 continues until the platform 1 has rotated sufficiently to cause the trailing edge of the surface portion 9 to pass from underneath the nozzle 2. At this time, the trailing edge of the opening 39 passes beyond the forward edge of the opening 26 cutting off the supply of air to the interior of the shell 5. The supply of air through the line 40 may also be terminated at this time. In the preferred embodiment of the invention, air under pressure is supplied to the interior of the shell 5 and the suction through the nozzle 2 is commenced when the platform 1 has rotated approximately 30° in the direction of the arrow 37 from the position shown in FIG. 1 and continues until the platform 1 has rotated approximately 68°–70° from the position shown in FIG. 1.

The supply of air to the control chamber 29 through the line 40 may be controlled by the apparatus illustrated diagrammatically in FIG. 7. As shown in FIG. 7, a cam 45, which is driven in synchronism with, but at twice the speed of, the platform 1, has a projection 46 thereon which is engageable with the roller 47 on the arm 48 of an air valve 49. Air under pressure is supplied to the valve 49 through a line 50. The cam 45 is also positioned relative to the roller 47 so that the projection 46 opens the valve 49 when the platform 1 is rotated approximately 30° from the position shown in FIG. 1. The circumferential length of the projection 46 is such that the valve 49 is closed when the platform 1 has rotated approximately 68°–70° from the position shown in FIG. 1. Of course, it will be understood that the valve 49 is operated twice during each revolution of the platform 1 so that air under pressure will be supplied to the interior of the shell 5 of each of the die units 3 and 4, when such die unit is moved from the position of the die unit 3 shown in FIG. 1 toward the nozzle 2.

It is preferred to turn the supply of air to the control chamber 29 on and off by means such as a valve 49, because sealing of the baffle 23 with respect to the other parts is not as important. Of course, since the control chamber 29 has two functions in the embodiment shown, it is necessary to turn the supply of air under pressure on and off. However, if suction is applied to the cores 7 in another manner or is unnecessary, then, air under pressure may be supplied continuously to the control chamber 29 with the supply of air under pressure to the interior of the shell 5 being controlled by the openings 38 and 39 in the baffle 23.

Although a preferred embodiment of the present invention has been illustrated and described, it will be understood by those skilled in the art that various modifications may be made without departing from the principles of the invention.

I claim:

1. In a cigar machine comprising a die unit for cutting a strip of tobacco having a first surface and a second oppositely facing surface to the desired shape, said die unit having a cutting edge which conforms to said shape and defines a space of said shape therewithin and having a strip receiving surface in fixed relation to said die unit and adjacent at least a portion of said cutting edge at the side of the latter opposite from said space, and vacuum means connectable to said die unit for drawing said strip toward said receiving surface and said first surface of said strip against said cutting edge, the combination therewith of means for directing air under pressure to said receiving surface in a direction away from the latter and toward the portion of said first surface of said strip which faces said receiving surface, a source of air under pressure, and control means for selectively connecting said vacuum means to said die unit and said source to said air directing means whereby portions of said strip adjacent said receiving surface may be drawn theretoward when said vacuum means is connected to said die unit and may be repelled from said receiving surface when said source is connected to said air directing means.

2. A cigar machine as set forth in claim 1, wherein said die unit comprises a shell at the outside of said cutting edge and the surface of a portion of said shell adjacent to said cutting edge is said receiving surface, wherein said portion of said shell has a plurality of apertures therethrough, said portion of said shell with said apertures forming said air directing means and wherein said control means comprises valve means for selectively connecting said source and said vacuum means to the interior of said shell.

3. A cigar machine as set forth in claim 2, further comprising a platform rotatably mounted for rotation around a predetermined axis and having a surface substantially perpendicular to said axis and wherein said die unit is mounted on said platform at said surface and said valve means is drivingly interconnected with said platform for operation of said valve means in timed relation to the rotation of said platform.

4. A cigar machine as set forth in claim 3, further comprising further vacuum means including a nozzle, said nozzle being mounted adjacent said surface of said platform for removing portions of said strip from said receiving surface.

5. In a cigar machine comprising a die unit for cutting a strip of tobacco having a first surface and a second oppositely facing surface to the desired shape, said die unit having a cutting edge which conforms to said shape and defines a space of said shape therewithin and having a strip receiving surface in fixed relation to said die unit and adjacent at least a portion of said cutting edge at the side of the latter opposite from said space, said die unit having openings therethrough at said receiving surface for the passage of air, vacuum means for drawing air through said openings in a direction which causes said strip to be drawn toward said surface and said first surface of said strip against said cutting edge, and vacuum means adjacent said die for removing portions of said strip from said surface, the combination therewith of means for supplying air under pressure to said openings for flow therethrough in a direction opposite to said firstmentioned direction to thereby direct air on the portion of said first surface of said strip which faces said receiving surface, and control means for selectively controlling both said firstmentioned vacuum means and said air supplying means and for thereby controlling the direction of the flow of air through said openings, whereby portions of said strip may be drawn against said receiving surface when the air flow is in said first-mentioned direction and may be dislodged from said receiving surface when the air flow is in the opposite direction.

6. In a cigar machine comprising a rotatable turret mounted on a stationary support having a plurality of walls and having a platform spaced from said support, a hollow die unit for cutting a strip of tobacco having a first surface and a second oppositely facing surface to the desired shape, said die unit being mounted on said platform and having a cutting edge which conforms to said shape and defines a space of said shape therewithin and having a strip receiving surface adjacent at least a portion of said cutting edge at the side of the latter opposite from said space, said die unit having openings therethrough at said receiving surface for the passage of air, vacuum means for drawing air through said openings in a direction which causes said strip to be drawn toward said surface and said first surface of said strip against said cutting edge, and vacuum means adjacent said die for removing portions of said strip from said surface, the combination therewith of means for supplying air under pressure to said openings for flow therethrough in a direction opposite to said first-mentioned direction to thereby direct air on the portion of the surface of said strip which faces said receiving surface, and control means for selectively controlling both said first-mentioned vacuum means and said air supplying means and for thereby controlling the direction of the flow of air through said openings, whereby portions of said strip may be drawn against said receiving surface when the air flow is in said first-mentioned direction and may be dislodged from said receiving surface when the air flow is in the opposite direction, said control means comprising a baffle with apertures therethrough intermediate said turret and said support and rotatable with said turret, said support having a wall adjacent said baffle and having apertures through said wall alignable at least in part with said apertures in said baffle upon rotation of said turret, said turret having at least one air passageway extending from an aperture in said baffle to the interior of said die and said walls of said support including said wall thereof forming at least one air chamber therein, said chamber forming part of said first-mentioned vacuum means.

7. A cigar machine as set forth in claim 6, wherein said walls of said support form a pair of air chambers each having at least one of said wall apertures in the portion of said wall forming it, one of said chambers forming part of said first-mentioned vacuum means and the other of said chambers forming part of said air supplying means.

8. A cigar machine as set forth in claim 7, wherein said control means comprises an air valve, an air line connecting said valve to said other chamber for delivering air under pressure from said valve into said other chamber and cam means operable in timed relation to the rotation of said turret for operating said valve when one of said apertures in said baffle is aligned at least in part with an aperture in the portion of said wall which forms part of said other chamber.

9. The method of processing a strip of tobacco having a first surface and a second oppositely facing surface in a cigar machine which comprises a cutting die unit for cutting a strip of tobacco to the desired shape, said die unit being movable from a first position to a second position and having a cutting edge which conforms to said shape and defines a space of said shape therewithin and having a portion adjacent to said cutting edge at the side thereof opposite from said space, said portion having apertures extending therethrough, said method comprising placing a strip of tobacco larger than the area of said shape on said cutting edge with said first face of said strip facing said portion, maintaining said strip thereon by drawing air through said apertures in a first direction extending away from said first face, pressing said strip against said cutting edge with said die unit in said first position to cut a portion of said strip into said shape while leaving other portions thereof on said portion of said die unit, removing said cut portion of said strip from said die unit, moving said die unit away from said first position toward said second position, and after said die unit has been moved from said first position, passing air through said apertures in a second direction opposite to said first direction to dislodge said other portions of said strip from said portion of said die unit while removing said other portions by suction directed away from said portion of said die unit.

* * * * *